US005094044A

United States Patent [19]

Dykmans

[11] Patent Number: 5,094,044

[45] Date of Patent: Mar. 10, 1992

[54] MULTI-PURPOSE DOME STRUCTURE AND THE CONSTRUCTION THEREOF

[76] Inventor: Maximilliaan J. Dykmans, 1214 Pioneer Way, El Cajon, Calif. 92022

[21] Appl. No.: 477,715

[22] Filed: Feb. 9, 1990

Related U.S. Application Data

[60] Continuation-in-part of Ser. No. 206,849, Jun. 15, 1988, which is a division of Ser. No. 559,911, Dec. 9, 1993, Pat. No. 4,776,145.

[51] Int. Cl.[5] ..... E04B 1/32

[52] U.S. Cl. ..... 52/80; 52/2.15; 52/223 R; 52/224; 264/32; 264/34; 220/319; 156/143; 417/38

[58] Field of Search ..... 52/2 E, 222, 223 R, 52/223 C, 224, 80, 81; 264/32, 34, 228; 220/319, 566, 445; 156/143, 295; 427/38

[56] References Cited

U.S. PATENT DOCUMENTS

| | | | |
|---|---|---|---|
| 1,870,487 | 8/1932 | Bitney . | |
| 2,185,749 | 1/1940 | Kennedy | 52/224 |
| 2,223,418 | 12/1940 | Hewett | 109/1.5 |
| 2,250,175 | 7/1941 | Blaski | 52/81 |
| 2,335,300 | 11/1943 | Neff | 264/32 |
| 2,388,701 | 11/1945 | Neff | 264/32 |
| 2,413,243 | 12/1946 | Neff | 264/32 X |
| 2,544,828 | 3/1951 | Dobell | 52/224 |
| 2,579,183 | 12/1951 | Freyssinet | 264/32 X |
| 2,833,593 | 5/1958 | Olivier . | |
| 2,836,529 | 5/1958 | Morris | 52/DIG. 7 X |
| 2,892,239 | 6/1959 | Neff . | |
| 3,118,010 | 1/1964 | Harrington . | |
| 3,277,219 | 10/1966 | Turner | 52/2 E |
| 3,278,128 | 10/1966 | Szulc | 52/224 |
| 3,280,525 | 10/1966 | Crowley | 52/224 |
| 3,338,010 | 8/1968 | Waugh . | |
| 3,409,222 | 11/1968 | Gelin . | |
| 3,410,039 | 11/1968 | Brezina . | |
| 3,462,521 | 8/1969 | Bini | 264/32 |
| 3,504,474 | 4/1970 | Dykmans . | |
| 3,510,041 | 5/1970 | Dykmans . | |
| 3,518,748 | 7/1970 | Howlett | 52/224 X |
| 3,572,596 | 3/1971 | Dykmans . | |

(List continued on next page.)

FOREIGN PATENT DOCUMENTS

| | | | |
|---|---|---|---|
| 707523 | 4/1965 | Canada | 52/224 |
| 1052103 | 6/1952 | Fed. Rep. of Germany . | |
| 2013337 | 9/1971 | Fed. Rep. of Germany . | |
| 2716325 | 10/1977 | Fed. Rep. of Germany . | |
| 2722984 | 11/1978 | Fed. Rep. of Germany . | |
| 3329296 | 2/1985 | Fed. Rep. of Germany . | |
| 935724 | 6/1948 | France | 52/224 |
| 2490745 | 3/1982 | France . | |
| 22470 | 2/1979 | Japan . | |
| 559009 | 9/1977 | U.S.S.R. . | |
| 0596291 | 3/1978 | U.S.S.R. . | |
| 715757 | 2/1980 | U.S.S.R. . | |
| 7616799 | 9/1980 | U.S.S.R. . | |
| 776077 | 6/1957 | United Kingdom . | |
| 815942 | 7/1959 | United Kingdom . | |
| 938939 | 10/1963 | United Kingdom . | |
| 2092215 | 8/1982 | United Kingdom . | |

OTHER PUBLICATIONS

A pictorial publication entitled: "Binishells Technology Pneumatically Formed Reinforced Concrete Structure"—4 pages.

(List continued on next page.)

*Primary Examiner*—Richard E. Chilcot, Jr.
*Attorney, Agent, or Firm*—Lyon & Lyon

[57] ABSTRACT

An improved dome structure on a base is disclosed comprising, in the preferred embodiment, of a membrane sandwiched between layers of rigidifying material such as shotcrete or reinforced composite which also serve to embed radial wires and circumferential tensioned prestressing. Various types of circumferential tensioned prestressing can be applied to minimize bursting stresses and can consist of steel wire as well as fiber or steel-reinforced tape. Further layers of rigidifying material can then be applied over the circumferential prestressing as a final protection and cover. The radial wires can contain spacers or hooks to preclude the circumferential prestressing from riding up on the structure. The lower portion of the dome can include a reverse curvature to minimize stresses and stabilize the structure. The rigidifying material may be composite which can be hardened by light curing. A second outer membrane can also be used for weather protection.

44 Claims, 5 Drawing Sheets

U.S. PATENT DOCUMENTS

| | | | |
|---|---|---|---|
| 3,619,432 | 11/1971 | Harrington . | |
| 3,643,910 | 2/1972 | Heifetz | 264/32 X |
| 3,666,189 | 5/1972 | Dykmans . | |
| 3,666,190 | 5/1972 | Dykmans . | |
| 3,719,341 | 3/1973 | Harrington . | |
| 3,765,605 | 10/1973 | Gusmer et al. . | |
| 3,769,763 | 11/1973 | Kwake . | |
| 3,801,009 | 4/1974 | Marshall, III . | |
| 3,824,751 | 7/1974 | Shelander . | |
| 3,886,961 | 6/1975 | Geiger et al. | 52/63 |
| 3,914,077 | 10/1975 | Lodes . | |
| 3,984,266 | 10/1976 | Christensen et al. | 52/DIG. 7 X |
| 4,021,972 | 5/1977 | Choate et al. | 52/2.15 |
| 4,069,642 | 1/1978 | Hendriks | 52/247 X |
| 4,077,177 | 3/1978 | Boothroyd et al. . | |
| 4,104,097 | 8/1978 | Gregory et al. | 156/143 |
| 4,126,976 | 11/1978 | Crowley . | |
| 4,144,680 | 3/1979 | Kelly | 52/80 |
| 4,155,967 | 5/1979 | South et al. | 52/2.15 X |
| 4,170,093 | 10/1979 | Cappellini | 52/2.15 X |
| 4,226,677 | 10/1980 | Saito et al. . | |
| 4,271,647 | 6/1981 | Balck, Jr. . | |
| 4,302,978 | 12/1981 | Dykmans . | |
| 4,302,979 | 12/1981 | Dykmans . | |
| 4,317,317 | 3/1982 | Kilts et al. . | |
| 4,320,075 | 3/1982 | Neilson . | |
| 4,321,776 | 3/1982 | Delight . | |
| 4,324,074 | 4/1982 | South et al. | 52/2.15 |
| 4,365,455 | 12/1982 | Braine | 52/741 |
| 4,372,733 | 2/1983 | Tinning et al. . | |
| 4,442,059 | 4/1984 | Boyce . | |
| 4,446,083 | 5/1984 | Nicholls . | |
| 4,468,412 | 8/1984 | Fujii et al. | 427/38 |
| 4,493,286 | 11/1985 | Carson . | |
| 4,550,544 | 11/1985 | Thoeny . | |
| 4,578,302 | 3/1986 | Schmidt et al. | 156/295 X |
| 4,588,541 | 5/1986 | Fowler . | |
| 4,593,360 | 6/1986 | Cocks . | |
| 4,628,861 | 12/1986 | Mitchell . | |
| 4,629,592 | 12/1986 | Harrington et al. . | |
| 4,642,856 | 2/1987 | Harrington . | |
| 4,776,145 | 10/1988 | Dykmans | 52/741 |
| 4,879,859 | 11/1989 | Dykmans | 52/741 |

OTHER PUBLICATIONS

Brochure entitled "The Dyk Igloo—Tomorrow's Technology at Yesterday's Prices"—2 pages.

A copy of the "AWWA Standard for Thermosetting Fiberglass—Reinforced Plastic Tanks", approved by the American National Standards Institute, Inc.

Two cover pages and p. 31 from the "Engineering Data for Aluminum Structures", Third Edition.

A portion of the "Venus Products Catalog", Third Edition—Front page and pp. 16, 17, 20, 21, 24–25, 56, 57.

Catalogs from the "Hercules" Company—14 pages.

Catalogs for the "Kab-O-Rap Company"—25 pages.

Brochure entitled "Tankinetics" copyrighted in 1975, Justin Enterprises Inc.—pp. 1–8.

J. J. Closner, "Slip Forms Raise Big Prestressed Tank", 8/1958, pp. 72–75 of Construction Methods and Equipment.

"Concrete Construction", Apr. 1988, vol. 33, No. 4, 22 pages, Opportunities with Inflated Forming.

"Concrete International", Jan. 1986, vol. 8, No. 1, 27 pages including articles.

1988 Computer Search re Harrington Patents and Exchange of Correspondence.

(List continued on next page.)

OTHER PUBLICATIONS

Max J. Dykmans; Summary of Structures, Designed, Built or Prestressed by BBR/DYK; revised Mar. 1986; pp. 1-11.

Max J. Dykmans; Cost Curves for Circular Prestressed Concrete Storage Tanks; (2 pages).

Max J. Dykmans; Parade of Accomplishments; (8 pages).

Max J. Dykmans; What is Wrong with Local General Contractors Building Prestressed Concrete Tanks?; pp. 1-11 (brochure).

Max J. Dykmans; Summary of Publications (A Pictorial Review of Brochures and Publications).

Max J. Dykmans; 1981 P.C.A. Award Winner (brochure 1 page).

Max J. Dykmans; The Dyk III Tank Machine—Another Technological Breakthrough (brochure-1 page).

Max J. Dykmans; Another Dyk Bar Stressing System (brochure-1 page).

Max J. Dykmans; The Dyk Strand Winner, brochure-pp. 1-4.

Max J. Dykmans; The Dyk II Strand-Winder, brochure-1 page.

Max J. Dykmans; Dyk-Vogt Wire Wrapping and Shotcreting Machine, brochure-1 page.

Max J. Dykmans; Automated Shotcrete & Sandblast, brochure-1 page.

Max J. Dykmans; Dyk Flat Steel Wrapping for Water & Sewage Tanks, brochure-1 page.

Max J. Dykmans; 1983 P.C.A. Award Winner/7 Mg Reservoir, Salt Lake City, Utah; 1 page.

Max J. Dykmans; 1984 P.C.A. Award Winner 2-6 Mg Reservoirs, Cerritos, California, 1 page.

Max J. Dykmans; 5 Mg Reservoir, Loveland, Colorado, 1 page.

Max J. Dykmans; City of Everett Water Reservoir #6, 1 page.

Max J. Dykmans; 1.6 Mg Reservoir, Newport Beach, California, 1 page brochure.

Max J. Dykmans; 40 Million Gallons of Prestressed Concrete Storage, 1 page.

Max J. Dykmans; 2 Mg Reservoir, San Clemente, California, 1 page brochure.

MULTI-PURPOSE DOME STRUCTURE AND THE CONSTRUCTION THEREOF

This is a continuation-in-part of a divisional application (Ser. No. 206,849 filed June 15, 1988) to application Ser. No. 559,911 filed Dec. 9, 1983, now U.S. Pat. No. 4,776,145, which issued on Oct. 11, 1988.

BACKGROUND OF THE INVENTION

This application is also related to application Ser. No. 396,377 filed Aug. 21, 1989, entitled "A Method And Apparatus For Constructing Circumferentially Prestressed Structures Utilizing A Membrane" which is a continuation of application Ser. No. 06/915,269 filed Oct. 3, 1986 and entitled "A Method And Apparatus For Constructing circumferentially Wrapped Prestressed Structure Utilizing A Membrane," which issued as U.S. Pat. No. 4,879,859, which in turn is a continuation-in-part of application Ser. No. 559,991 filed on Dec. 9, 1983 and entitled "Multi-Purpose Dome Structure And Construction Thereof," which issued as U.S. Pat. No. 4,776,145.

This application is also related to Ser. No. 07/436,479 filed Nov. 14, 1989, entitled "A Method And Apparatus For Constructing Circumferentially Prestressed Structure Utilizing A Membrane Including Seismic Coupling," which is a divisional of application Ser. No. 06/915,269, filed Oct. 3, 1986, which was a continuation-in-part of application Ser. No. 559,911 filed on Dec. 9, 1983.

There is presently pending Ser. No. 07/444,839, filed Dec. 1, 1989, entitled "Automated Accurate Mix Application System For Fiber Reinforced Structures" which is a continuation-in-part of Ser. No. 050,317 filed May 14, 1987, which issued as U.S. Pat. No. 4,884,746 and is entitled "Ripple Free Flow Accurate Mix And Automated Spray System" and Ser. No. 07/434,322 filed Nov. 13, 1989, also entitled "Ripple Free Flow Accurate Mix And Automated Spray System," which is a divisional of Ser. No. 07/050,317, filed May 14, 1987 above.

The field of the present invention is of dome structures and their construction which can be used to contain liquids, solids or gases or to provide temporary or permanent shelter.

There has been a need for the facile construction of dome-type structures, as conventional construction of these structures has proven difficult and costly and the structures themselves have had problems with stability and leakage.

Certain of these conventional structures have utilized inflated membranes. Indeed, inflated membranes have been used for airport structures where the structure consists of the membrane itself. Inflated membranes have also been used to form concrete shells wherein a membrane is inflated, and used as a support form. Concrete is placed over the membrane and the membrane is removed after the concrete has hardened. Conventional systems called "Binishells" are systems of this type. These are constructed by placing metal springs and reinforcing over an uninflated lower membrane. Concrete is placed over the membrane and then the membrane is inflated while the concrete is still soft. An upper membrane is placed over the concrete to prevent it from sliding to the bottom as the inflation progresses. After the concrete has hardened the membranes are typically removed. Literature regarding "Binishells" technology is provided under cover of the disclosure statement submitted. It is noted however that the steel springs of the Binishells cannot be used effectively, or economically, in the spring direction (center line of the spring) to restrain tensile forces in, and prestress the concrete. Only bursting forces inside the spring, transverse to the spring direction, can be retained effectively by the wire spiral since the bursting forces will put the wire spiral in tension along the linear direction of the wire. Besides economic considerations which by themselves militate against using springs as prestressing, springs used in the direction of the spring as tensile members, offer excessive strains and creep to be acceptable as prestressing. This coupled with the fact that the spring would not tension the concrete in the axial or linear direction of the wire and indeed forms a sinusoidal pressure pattern, make the subject invention superior to the Binishells system.

SUMMARY OF INVENTION

The present invention is directed to axis-symmetrical, parabolic, round, elliptical or other similar structures that can be used to contain liquids, solids and/or gases and to provide temporary or permanent shelter. A membrane may be inflated to the desired shape against radial elements. The interior and exterior of the inflated membrane is coated with a rigidifying material of various types which hardens forming a structural composite layer with the membrane sandwiched in between. Circumferential prestressing is applied by winding a tensioned member around the structure to place the structural composite layer in compression. An outer membrane may be used for weather protection.

In the construction, the radial elements may be fastened on one end to a base comprised of a circular footing, integral with or attached to a floor, upon which the dome structure rests. Additional radial elements may be added as desired, with the elements optionally tensioned. Circumferential high-tensile prestressing tensioned elements may be applied around the structure to counteract the bursting force provided by the materials or liquids contained in the dome. Final rigidifying material may be applied over the circumferential prestressing as a final protection or cover.

In a further aspect of the present invention, a reverse (inward) curvature of the dome walls near the base may be employed where the dome is connected to the footing, which in many instances can be positioned below the surface of the ground (or backfill). When a circumferential prestressing force is applied to the dome, there is a tendency for the rigidifying material outside the membrane to be forced up along the membrane surface creating a separation between the rigidifying material and the membrane. The reverse curvature of the dome avoids this by providing an anchor for the radial prestressing on the dome surface itself. The upward forces acting above the point of largest diameter of the curvature are countered by the forces acting below that point of largest diameter.

Moreover, besides providing an anchor for circumferential prestressing in the rigidifying material outside the membrane, the reverse (inward) curvature near the base of the dome will also reduce the uplift caused by pressure from the contents of the dome, for example, by water pressure if the dome is used as a water tank.

Furthermore, the increased thickness of the rigidifying material at the base of the dome stiffens the structure against seismic, wind and other asymmetrical horizontal forces.

Finally, to minimize vertical bending stresses in the walls near the bottom of the dome, the dome walls are placed on resilient bearing pads to permit a free radial movement of the shell with respect to the base.

Figure 2:
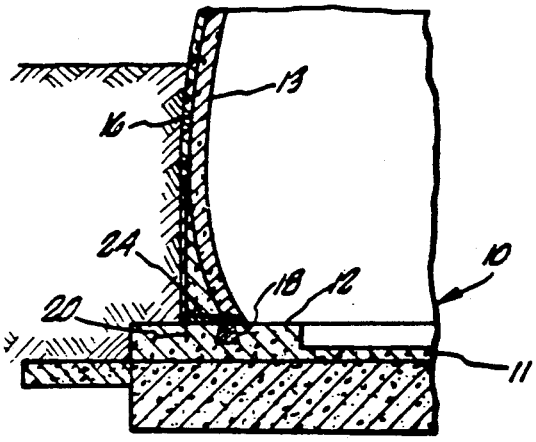
FIG. 2 is a cross-sectional view of a portion of an embodiment of the dome structure illustrating the connection between the base, floor and composite wall formed of the membrane sandwiched between layers of rigidifying material (at least one inner layer inwardly of the membrane and towards the interior of the tank, and at least one outer layer outwardly of the membrane and towards the exterior of the tank) with circumferential tensioned prestressing embedded therein. This figure illustrates a preferred embodiment wherein the dome walls curve inwardly near the base of the dome (towards the center of the floor) to reduce uplift and otherwise stabilize the dome. The inwardly curved portion of the walls may be buried in the ground below the surface of the backfill.

The inner membrane is anchored to the inner ring or base 43 comprised of the circular footing integral with or attached to the floor upon which the dome structure rests (See FIG. 2). The tower structure 40 rotates on a carriage resting upon the inner tank footing. The outer membrane is likewise anchored to an outer ring or base 44.

DETAILED DESCRIPTION OF THE PREFERRED EMBODIMENTS

Figure 1:
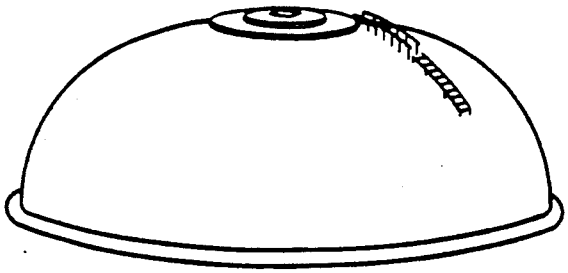
FIG. 1 is a perspective view of a finished dome structure.
Figure 9:
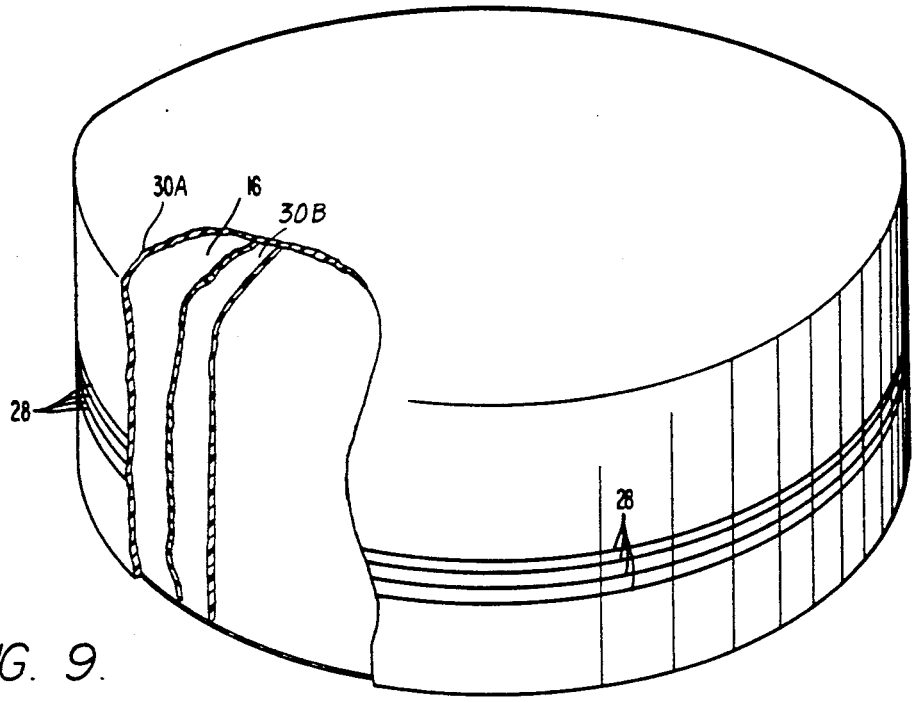
FIG. 9 shows an elevated view of the tank, with the walls cut away to show the membrane, positioned between the inner 30B and outer 30A layer of rigidifying material and circumferential prestressing 28 wound helically on the outside of the rigidifying material and membrane.

Turning in detail to the drawings and particularly FIG. 1, a dome structure is disclosed for the containment of liquids, solids or gases, or to provide temporary of permanent shelter. The axis-symmetrical structure can be parabolic, round, elliptical or other similar shape. Turning more specifically to FIG. 2, a preferred embodiment of the dome structure is illustrated showing a base 10 including concrete floor 11 with or without reinforcing bars embedded therein. The base includes a footing 12 to support the dome walls !3 of the structure. Another embodiment is shown in FIG. 9.

Figure 3:
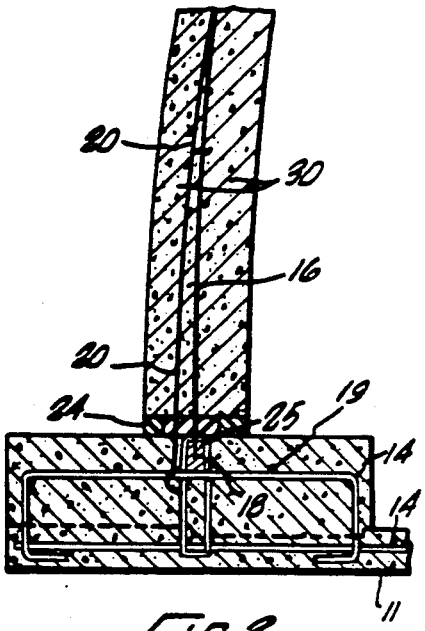
FIG. 3 is a cross-sectional view of another embodiment illustrating the connection of the composite dome walls to the base. The membrane 16 is shown with vertical 20 as well as circumferential 28 prestressing both of which are sandwiched between an outer 30A and inner 30B layer of rigidifying material shown in expanded form in FIG. 4. In this embodiment, the dome walls do not curve inwardly near the base of the dome.

FIG. 2 shows the connection between the dome walls and the base which is magnified in greater detail in FIG. 3. As shown therein, the base 10 and integral footing 12 are reinforced circumferentially with number four galvanized bars (14). Membrane 16 is fastened to the base utilizing the hold-down means 18 which include a key with epoxy fill.

The radial members 20 and their relationship vis-a-vis the membrane and base are also shown in FIG. 3 which illustrates how the radial members 20 are embedded into the concrete base !0 and hooked around radial reinforcing bars embedded in the floor slab. Radial members include but are not limited to steel wire, seven T-M wire strand, wire rope or glass, carbon or other type fiber. The dome walls rest on a polyurethane pad 19, or the like, of a width sufficient to support the dome, but not so great as to cause large radial base restraints. Sponge rubber such as closed cell neoprene sold under the trademark RUBATEX 24 is used in the remaining portion of the joint, not occupied by the polyurethane pad. The purpose of the Rubatex is to insure adequate separation of the dome walls and the base with a minimum of restraint.

Figure 4:
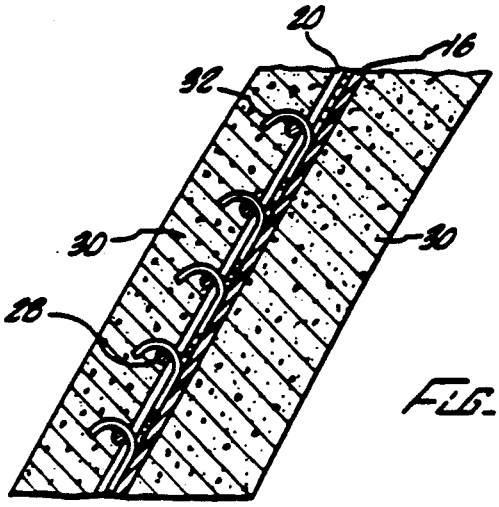
FIG. 4 is an expanded cross-sectional view of the composite wall illustrating the membrane sandwiched between layers of rigidifying material (an inner layer 30B and outer layer 30A) with the radial elements and circumferential prestressing embedded in the rigidifying material but positioned outwardly or exterior to the membrane 16. Spacers or hooks as well as stabilizing bars, integral with the radial elements, serve as anchoring and aligning means to position the circumferential prestressing and prevent it from moving to the top or apex of the dome.
Figure 10:
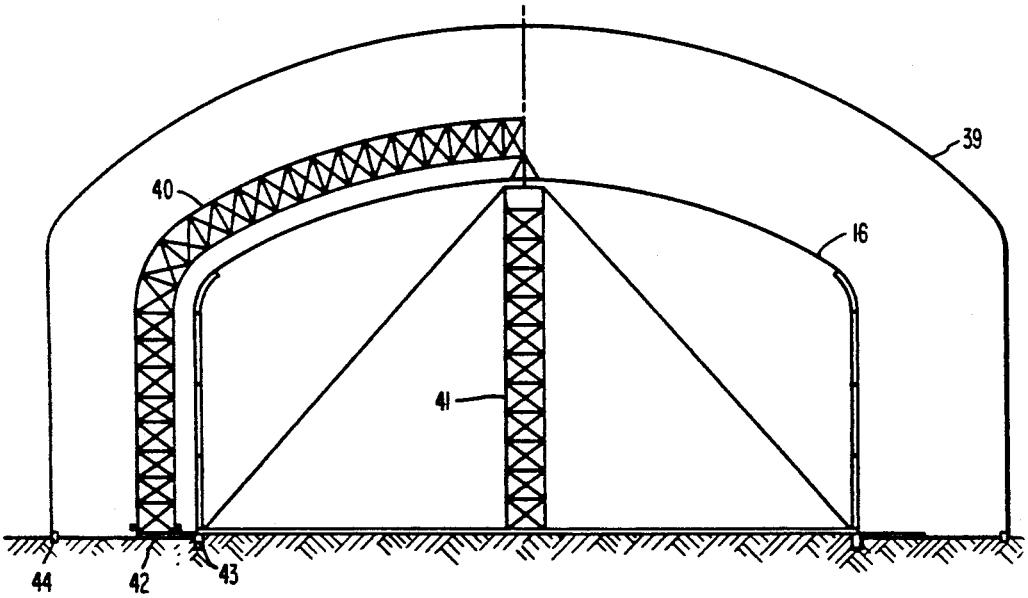
FIG. 10 shows a side view of the tank illustrating the inner 16 and outer 39 membrane.

FIGS. 4 and 10 show how rigidifying material 30, such as shotcrete, concrete, fiberglass-reinforced epoxy or other type of laminate, or a combination thereof is applied in circular layers to the inside and outside of the membrane 16 to form a composite wall of the required thickness. The membrane 16 is commonly made of a nylon-reinforced or polyester-reinforced vinyl, which is cut, spliced and sealed in a manner that it will inflate to the desired shape of the final dome configuration. This shape may be parabolic, round, elliptical or other, and is commonly symmetrical around the vertical axis of the shell. The membrane is securely fastened by epoxy fill !8 or the like to provide a tight seal between the dome walls and the base. The membrane is then inflated by air such that it pushes against the radial prestressing 20 to help form the desired shape.

FIG. 10 illustrates the embodiment where an outer membrane 39 is used. The outer membrane is generally of the same shape as the inner membrane 16 except that it is much larger to clear the revolving spraying and pretensioning equipment shown diagrammatically as the curved tower structure 40 on the riding pad 42. The outer membrane 39 is also used to protect any spraying and curing operations from the weather. As shown in FIG. 10, the inner concrete footing on ring 43 whereas the outer membrane is anchored and supported by an outer footing or ring 44. The inventor contemplates the best mode of practicing this invention by utilizing automated spraying and pretensioning equipment such as that set forth in detail in U.S. Pat. Nos. 3,572,596; 3,666,189; and 3,869,088 and in the brochure which is attached to disclosure statement filed. Generally, the wrapping and spraying equipment is mounted on a tower structure (40) which travels on a riding pad 42 located around the inner tank footing 43 or 10. The revolving tower 40 may be temporarily supported by center tower 42 anchored by cables to the inner ring footing. The equipment thus revolves around the tank spraying the proper amount of rigidifying material, and, in a later operation, winding steel wire under tension around the tank followed by encasing the steel wire in layers of rigidifying material. The outer membrane 39 is used to protect these operations, especially the spraying and curing operations of the rigidifying material, from fluctuating weather conditions. The inner and outer inflated membranes are held down from the uplift forces by circular concrete rings anchored to the ground. FIG. 10 shows an inner concrete ring or base 43 anchoring the inner membrane 16 and the outer concrete ring or base 44 anchoring the outer membrane 39.

Figure 6:
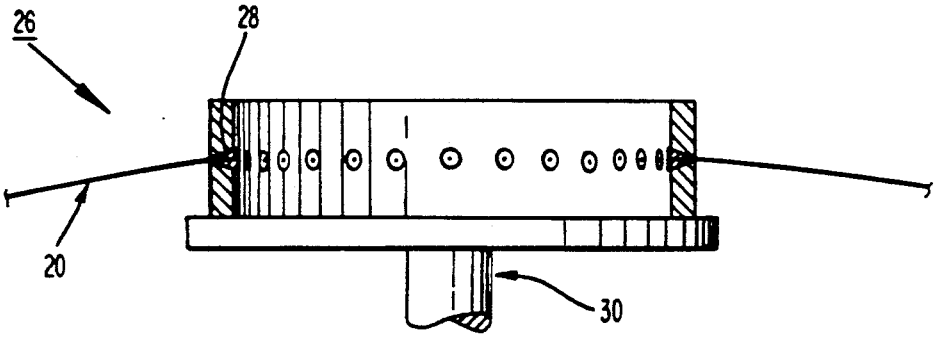
FIG. 6 is a partial cross-sectional view of the ring support which, in a preferred embodiment, holds the radial prestress wire in place above the base of the structure. The ring support need not be supported by the post, but rather can be supported by the inflated membrane.
Figure 7:
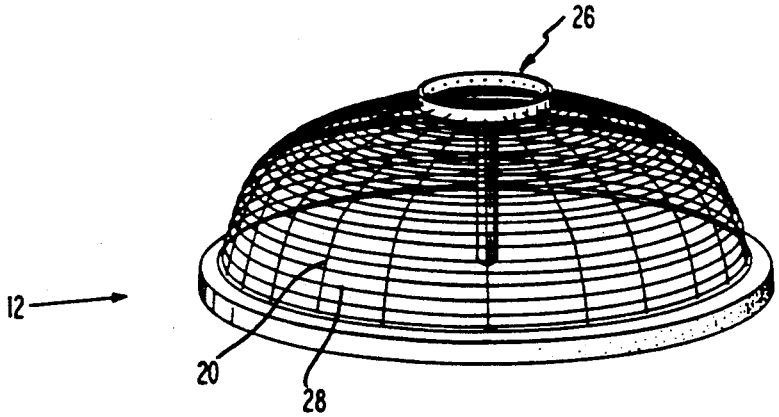
FIG. 7 is a perspective view of an embodiment of the claimed dome structure illustrating the interrelationship between the support ring, vertical element, circumferential prestressing, membrane and base comprised of a circular footing with or attached to the floor of the structure upon which the dome structure rests.

In the preferred embodiment, radial wires or elements are connected to a fastener such us the ring structure 26 in FIG. 6 which is preferably centered above the base of the structure. The ring 26 shown in FIG. 6 contains holes which receive and fasten the radial wires 20. The wires can be fastened using wedge anchors such a those illustrated by number 28. The ring support 26 can be positioned above the slab by a post 30 or by other suitable means, such as the air pressure in the membrane. The radial members are connected to such a ring, preferably located at the center of the dome structure. The wire extends from the ring 26 to the footing 12 of the structure. Each wire is capable of being adjusted or tensioned to help maintain the desired shape or configuration, minimize skin stresses in the fabric and ultimately provide radial prestressing to help contain the bursting force of the material stored within the dome structure.

Figure 5A:
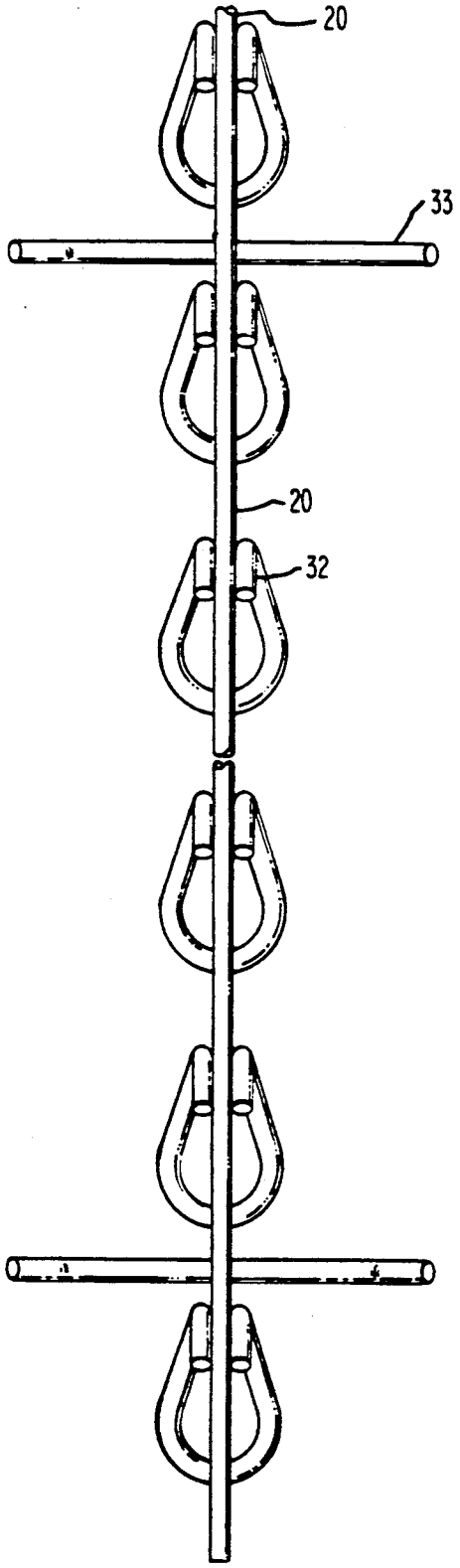
FIGS. 5A and 5B are cross-sectional views of the radial wire with cable spacers or hooks, as well as stabilizing bars (the anchoring and aligning means), used to prevent the circumferential prestressing from sliding up on the structure when tensioning is applied.
Figure 5B:
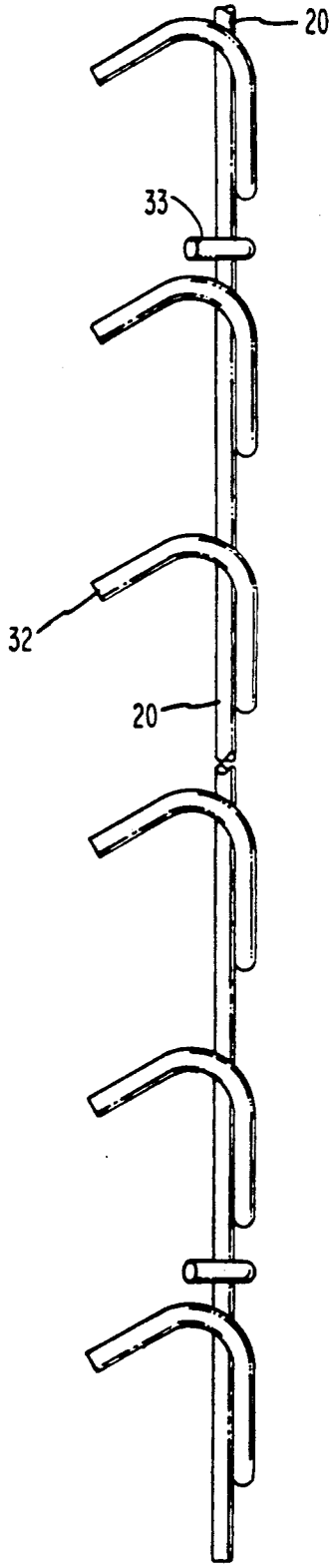

The radial wires 20 can include anchoring and aligning means consisting of galvanized cable spacers or hooks 32 and stabilizing bars 33 as shown in FIGS. 5A and 5B. The cable spacers ar attached and integral to the radial wires 20, anchored to the footing 12 of the structure at one end and to the support ring 26 on the other. The cable spacers facilitate circumferential prestressing in that they can prevent the wrapped circumferential members, such as wires 28 (see FIG. 4), from sliding up on the dome surface. The cable spacers also help minimize circumferential arching of the membrane between the radial wires. The stabilizing bars 33 allow for proper positioning of the cable spacers or hooks vis-a-vis the membrane. Instead of cable spacers or hooks, the exterior shotcrete surface can also be stepped or keyed to accommodate the circumferential prestressing. Furthermore, the circumferential prestressing can consist of fiber reinforced tape adhering to the surface to which it is applied.

The inside and outside of the membrane can be sprayed with rigidifying material, such as shotcrete, 30 by manual or automated methods. Such methods are described in U.S. Pat. Nos. 3,572,596 which prescribes how layers of rigidifying material can be sprayed, after each preceding layer is allowed to cure, and additional layers can be added thereon until the walls reach a desired thickness, and illustrated in the brochures relating to the subject structure which are provided herewith, all of which are incorporated herein reference. For shotcrete, either wet or dry mix material can be used.

Figure 8:
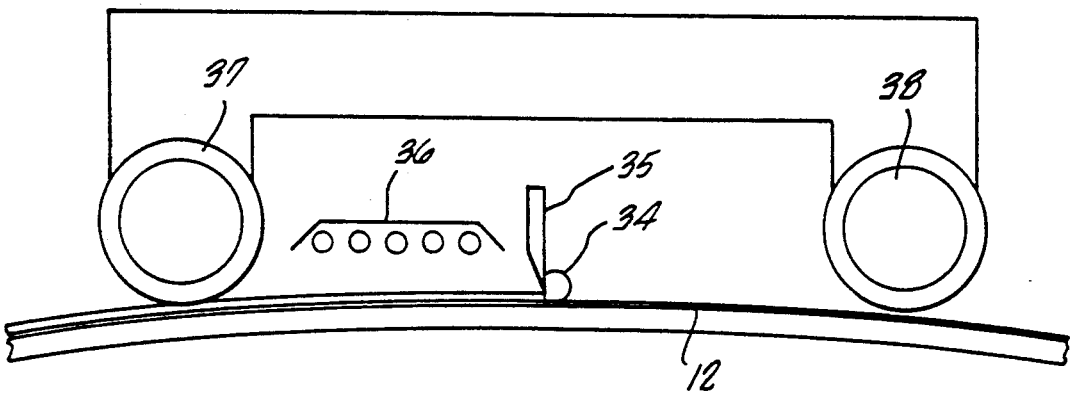
FIG. 8 is a cross sectional view of the light curing aspect of the present invention.

An alternate procedure to "shotcreting" (by manual or automated methods such as spraying) is the laying of a pre-mixed fiber reinforced resinous material in which the resin is not cured by catalysts or heat, but by light, not unlike that given off by neon tubes. Turning now to FIG. 8, the premixed material 34 is pumped to a revolving vertical flat screed bar 35 with a tapered, sharp edge on the wall side. The pre-mixing may be accomplished by the use of the apparatus in copending application Ser. No. 050,317. The clearance between the screed bar and the wall may be in the order of 1/16" to ⅛" depending on the viscosity of the paste. The tapered side of the screed bar is normally on the trailing side of the screed bar. The viscosity of the mixed material—or paste 34—is carefully controlled to permit a bead of paste to develop in front of the screed 35 which gets drawn under the screed. Following immediately behind the screed is a bank of lights 36 suitable to cure the selected resin in the mixed material—which at least forms a stable skin on which vertical rollers 37 and 38 can ride to level and consolidate the applied paste. The entire wall can so be built from numerous layers of a wide variety of composite or rigidifying materials laid upon the membrane 16. The vertical screeds move in a spiral motion around the tank wall. The premixed-light cured-composites offer advantages over sprayed systems including ease of operation, substantially reduced vapor emissions and ability to operate at high and low temperatures including freezing. To facilitate construction in adverse weather conditions, as shown in FIG. 10, a second inflated membrane can be installed to cover, and enclose the entire structure under construction.

Upon completion of the shotcreting process, the air pressure, which has caused the membrane to inflate to the desired shape, can be released causing the tensioned radial wires to place the dome in compression. Additional compression in the wall is developed through the tension in the membrane.

After a sufficient amount of rigidifying material is placed on the outside surface, circumferential high tensile prestressing, such as wire strands, or fiberglass can be applied by machine or manual methods in sufficient quantities size and force to accommodate the design loads of the structure, so that the loading conditions of whatever material is stored in the structure are counteracted. In addition, compensation for differential temperature and drying stresses can also be accounted for. For purposed of this disclosure, rigidifying material is defined as a variety of materials including concrete solid fiber reinforced plastic (FRP) fiber reinforced plastic combinations. Typically, the layers of rigidifying material which are laid one upon the other on the membrane layers may be reinforced by multi-directional short fibers made of glass, steel, synthetics, organics or asbestos. Another form of prestressing the rigidifying material wall, in addition to steel wire, is woven fabric made from glass fibers, steel fibers, nylon fibers, organic fibers or synthetic fibers. The rigidifying material typically also can contain resin such as polyester resin, halogenated polyester, Bisphenol-A Fumarate resin, vinyl ester, isopthalic resin or epoxy resin and the like.

Circumferential stressing can be applied utilizing the apparatus and techniques described in U.S. Pat. Nos. 3,572,596; 4,302,978; 4,302,979; 3,504,474; 3,510,041; 3,666,189 and 3,666,190; as well as set forth in the accompanying brochure filed herewith which illustrates the subject structure, the disclosure of all of which are incorporated herein by reference. The circumferential member which is wrapped around the tank is in tension and constitutes prestressing. This is in contrast with concrete which is merely reinforced in contrast to prestressed. Prestressing requires high tensile steel for it to retain its elasticity and keep the walls of the dome in compression. In the context of a containment vessel, since concrete is not very good in tension, it is desired to apply tension or prestressing in order to make sure that the dome does not crack and therefore leak.

The purpose of prestressing is to place the material in a precalculated amount of compression, before it is subjected to loadings, so that the sum of the anticipated maximum tensile stresses developed from such loadings and the initial compressive stresses induced by the prestressing will provide the desired stress or strain in the material. Therefore, in prestressing, the prestressing wire is placed in tension before the load is applied to the material.

In contrast, with regular reinforcing, the reinforcing material will not see tension until after the load has been applied to the material. Likewise, in a reinforced tank, the reinforcing bars are not in a state of tension and do nothing until the tank is filled. At that point the walls tend to move out under the pressure from the water. Only then do the bars go into tension. In a reinforced concrete tank, the walls typically cannot take tension and cracks are formed through which leakage can occur. Contrast this with prestressed tanks where the walls are initially placed in compression by the circumferential tensioned prestressing exerting a force greater than that exerted by the tension caused by the water load. Of course, circumferential prestressing, such as steel wire, should not be pretensioned beyond its elastic limit.

Circumferential prestressing can be applied in multiple layers with rigidifying material, such as shotcrete or the equivalent, between each layer. It can also be placed in a single layer. As set out in U.S. Pat. No. 3,666,189 above, in wrapping wire around a concrete tank to prestress the same, a carriage (e.g. 40 in FIG. 10) is caused to travel around the tank by a motor-driven sprocket wheel thereon engaging a chain which extends tightly around and on the tank. Simultaneously the wire is fed from a supply spool onto a wire-gripping drum and is then laid on the outer tank wall with a wire tension established by monitoring deviations in stress with respect to a nominal value of stress, and using such deviations to produce changes in the differences in peripheral linear speed between on the one hand the sprocket wheel speed (carriage speed) and on the other hand the linear speed of the wire-gripping drum. Such stress is maintained substantially constant at the same nominal value whereby the wire is uniformly and accurately stressed when and as it is being wrapped around the tank wall.

A platform carrying wire tensioning apparatus may be raised or lowered on the carriage during carriage movement, either in the forward direction or in reverse direction or when the carriage is at a standstill.

Means are incorporated to assure a constant spacing between wire convolutions. Also control means are incorporated to maintain constant tension regardless of carriage speed either in a forward or reverse direction or at carriage standstill. The wire may be laid in a continuous helix or in steps accurately controlled as to height. Also means are incorporated to achieve or maintain an automatic wire tension regardless of carriage movement in either direction of carriage movement or at standstill. Further, the wire may be tensioned from a slack or zero tension condition to any desired tension and maintained automatically at such tension without requiring carriage movement. Also, the desired tension may be preadjusted to any desired value while the carriage is in motion either in the forward or reverse direction. A hydraulic-electrical system is used for these purposes.

If additional radial wires are required, they can be added over the circumferential prestressing or shotcrete, or rigidifying material overcoat. If cable spacers or hook wires are not used, circumferential prestressing can be applied into slots, keyways or steps to prevent the circumferential prestressing from sliding up the dome surface.

Upon completion of the placement of all circumferential prestressing and/or radial wires, shotcrete or other rigidifying material can then be applied manually or by automation over the outside to provide the desired protective cover. A final paint, epoxy or other type of sealing material may be applied over the shotcrete shell as additional protective covering.

In the preferred embodiment, the sequence of construction resulting in a dome structure according to the present invention is as follows.

A base 10 is constructed with or without an integral footing 12 as required. Regular or prestressed reinforcing rods 14 and 19 can be used to strengthen the base. Thereafter, the membrane 16 is installed and sealed in slot 18 in the base. The ring 26 is then positioned centrally above the base, and radial wires 20 are extended loosely between the base and ring. The prestressing wires are connected to the footing on one end and on the other end to the ring. They are fastened to the ring by wedge anchors 28.

The next step involves the inflation of the membrane, tailored to form the desired shape within the radial wires which applies tension to the radial wires and provides the desired form, which in the preferred embodiment is elliptical in shape.

Rigidifying materials such as shotcrete is then applied both below (inwardly) and above (outwardly) the membrane, forming an inner and outer layer sandwiching and embedding the membrane and radial wires therein. Once the shotcrete has partially cured, the air which caused the membrane to expand to the desired range is released. The concrete is therefore placed in compression and a self-sustaining dome is formed. The membrane is not removed but remains imbedded in the concrete forming a seal or waterstop and preventing the dome structure from leaking.

If circumferential tensioned prestressing is desired, cable spacers 32 can be used. Wires containing these cable spacers can be interspersed throughout the structure. The cable spacers position and prevent the circumferential prestressing from riding up on the structure. Further layers of shotcrete, epoxy or sealer can be placed on top of the circumferential prestressing.

Once circumferential prestressing is accomplished a structure has been created which is capable of withstanding substantial internal pressure from the containment of liquids gases and the like.

Thus, an improved dome structure is disclosed. While the embodiments and applications of this invention have been shown and described, it would be apparent to those skilled in the art that many more modifications are possible without departing from the inventive concepts herein. The invention therefore is not to be restricted except in the spirit of the appended claims.

I claim:

1. A structure of composite construction comprising:
a) a base;
b) radial prestressing affixed to the base;
c) a membrane tailored to form the desired shape of the structure positioned inwardly of said radial prestressing;
d) a first layer of rigidifying material on one surface of said membrane;
e) a second layer of rigidifying material on the other surface of said membrane;
f) tensioned circumferential prestressing applied outward of said radial prestressing;
g) a protective covering of rigidifying material applied over said circumferential prestressing; and
h) the radial prestressing including anchoring and aligning means to prevent the circumferential prestressing from riding up the structure as tensioning is applied.

2. The structure of composite construction of claim 1 wherein a protective covering is applied at least in part to serve as one anchoring and aligning means.

3. The structure of composite construction of claim 1 wherein the anchoring and aligning means comprise cable spacers in the form of inverted hooks preventing the tensioned circumferential prestressing from riding up the structure.

4. A prestressing structure for a dome comprising:
a) first prestressing elements;
b) second tensioned prestressing elements positioned above the first;
c) restraining means which restrain the second prestressing elements from riding up the structure, as tension is applied to said second prestressing element;
d) the restraining means including inverted restraining hooks and stabilizing bars.

5. The prestressing structure for a dome in claim 4 wherein the second tension prestressing elements comprise wire reinforced tape.

6. The prestressing structure for a dome in claim 5 wherein the wire reinforced tape is adhesive to the surface it is applied on thereby restraining the second tensioned prestressing elements from riding up the structure.

7. A structure of composite construction comprising:
a) a base;
b) radial prestressing affixed to the base;
c) a membrane tailored to form the desired structural shape positioned inwardly of said radial prestressing;
d) a first layer of rigidifying material on one surface of said membrane;
e) a second layer of rigidifying material on the other surface;
f) tensioned circumferential prestressing applied helically outward of said radial prestressing;
g) a protective covering of rigidifying material applied over said circumferential prestressing; and
h) the radial prestressing having anchoring and aligning means.

8. The structure of composite construction of claim 7 wherein the anchoring and aligning means comprise cable spacers in the form of inverted hooks.

9. The structure of composite construction of claim 7 in which the desired shape includes an inward curvature defined by a radially diminishing dimension starting at a point above the base moving towards said base.

10. A structure of composite construction comprising:
a) a base;
b) radial members affixed to the base;
c) an inflatable membrane tailored to form a desired shape positioned inwardly of said radial members;
d) a first layer of rigidifying material on the outer surface of said membrane;
e) a second layer of rigidifying material on the inner surface of said membrane;
f) prestressing wire circumferentially wrapped in tension around and contiguous to the first layer of rigidifying material with the prestressing force in the linear direction of the wire.

11. The structure of composite construction of claim 10 wherein said prestressing wire consists in part of fiber reinforced tape.

12. The structure of composite construction of claim 10 wherein said prestressing wire is protected by a layer rigidifying material sprayed thereon.

13. The structure of composite construction of claim 10 in which the desired shape includes an inward curvature defined by a radially diminishing dimension starting at a point above the base moving towards said base.

14. The structure of composite construction of claim 11 wherein said fiber reinforced tape is adhesive to the surface applied.

15. The structure of composite construction of claim 11 where said fiber reinforced tape consists of multiple parallel wires.

16. The means of composite construction of claim 10 wherein said rigidifying material consists at least in part of resin.

17. The structure of composite construction of claim 16 wherein said resin is light curable.

18. The structure of composite construction of claim 10 wherein the bursting forces on said composite construction are in substantial alignment with the axial direction of said prestressing wire.

19. A structure of composite construction comprising:
a) a base;
b) radial members affixed to the base;
c) an inflatable membrane tailored to form a desired shape positioned inwardly of said radial member;
d) a first layer of rigidifying material applied on one surface of said membrane;
e) a second layer of rigidifying material applied to the other surface;
f) a continuous tensioned member positioned contiguous to the outer layer of rigidifying material outwardly of said radial member.

20. A structure of composite construction comprising:
a) a base;
b) at least one radial member affixed to the base;
c) an inflatable membrane tailored to form a desired shape positioned inwardly of said radial member;
d) a first layer of rigidifying material applied on one surface of said membrane;
e) a second layer of rigidifying material applied on the other surface;
f) a continuously tensioned prestressing member wrapped around the structure outwardly of said inflatable membrane wherein the bursting forces are substantially aligned in the axial direction of said prestressing members.

21. A structure of composite construction comprising:
a) a base;
b) at least one radial member affixed to the base;
c) an inflatable membrane tailored to form a desired shape positioned inwardly of said radial member;
d) a first layer of rigidifying material on one surface of said membrane;
e) a second layer of rigidifying material on the other surface;
f) a continuously tensioned member helically wrapped around the structure outwardly of said inflatable membrane.

22. The structure of claim 21 wherein the continuously tensioned member is wire reinforced tape.

23. A structure of composite construction comprising:
a) a base;
b) a radial member affixed to the base;
c) an inflatable membrane tailored to form a desired shape positioned inwardly of said radial member;
d) a first layer of rigidifying material on one surface of said membrane;
e) a second layer of rigidifying material on the other surface;
f) a continuously tensioned member helically wrapped around the structure outwardly of said inflatable membrane and upwardly from the base.

24. A structure of composite construction comprising:
a) a base;
b) a membrane tailored to form a desired shape
c) radial prestressing affixed to the base and positioned outside of said radial prestressing;
d) a first layer of rigidifying material on the inside surface of said membrane;
e) a second layer of rigidifying material on the outside surface; and
f) tensioned circumferential prestressing wrapped helically outward of said radial prestressing outside and around said second layer of rigidifying material.

25. The structure of composite construction of claim 24 wherein said rigidifying material consists at least in part of resin.

26. The structure of composite construction of claim 25 wherein and resin is light curable.

27. A structure of composite construction comprising:
a) a base;
b) an inflatable membrane tailored to form a desired shape;
c) a first layer of rigidifying material on one surface of said membrane;
d) a second layer of rigidifying material on the other surface of said membrane;
e) circumferential prestressing tensioned to place said first and second layer of rigidifying material in compression.

28. The structure in claim 27 including anchoring and aligning means to prevent said prestressing material from sliding transversely to the direction of said circumferential prestressing.

29. The structure in claim 27 including deploying radial prestressing material to strengthen or shape said membrane.

30. The structure in claim 27 deploying radial prestressing material to radially compress said rigidifying material.

31. The structure in claim 27 in which the desired shape is a dome-shaped surface of revolution around a substantially vertical axis.

32. The structure in claim 31 in which said dome-shape surface of revolution has an inward curvature near the base's periphery.

33. The structure in claim 32 in which the circumference of the inward curvature begins decreasing at a certain distance above the base to said base to form said inward curvature.

34. The structure in claim 31 with the membrane shaped to create an inward curvature of the dome near the periphery of the base, to facilitate downward pressure on the dome by the contents of the dome.

35. The structure of claim 27 in which said radial prestressing is adjustably anchored in a ring at the apex of the dome.

36. The process in claim 27 in which said rigidifying material is in part shotcrete.

37. The process in claim 27 in which said rigidifying material is in part resinous.

38. The process in claim 37 in which said resinous material is light curable.

39. The process in claim 27 in which said rigidifying material is in part fiber reinforced.

40. The process in claim 27 in which said prestressing material is in part fiber reinforced tape.

41. The process in claim 40 in which said fiber reinforced tape consists in part of steel fibers.

42. A prestressed dome structure comprising:
a) first tensioned prestressing elements
b) second tensioned prestressing elements positioned above the first;
c) restraining means which restrain the second prestressing elements from riding up the structure towards area of decreasing radii, as tension is applied to said second prestressing element.

43. The structure of claim 42 wherein at least said second prestressing element consists in part of fiber reinforced tape adhesive to the surface applied.

44. The structure in claim 42 wherein said fiber reinforced tape consists in part of multiple parallel wires.

* * * * *